United States Patent [19]

Furutsutsumi

[11] 4,060,874

[45] Dec. 6, 1977

[54] APPARATUS FOR REMOVING DUST HAVING DEVICE FOR PRODUCING AIR CURTAIN

[76] Inventor: Yasuzi Furutsutsumi, 1-19, 2-chome, Midoridai, Kawanishi, Hyougo, Japan

[21] Appl. No.: 658,668

[22] Filed: Feb. 17, 1976

[30] Foreign Application Priority Data

Feb. 21, 1975 Japan ..... 50-24987[U]
Apr. 15, 1975 Japan ..... 50-50759[U]

[51] Int. Cl.[2] ..... A47L 5/14

[52] U.S. Cl. ..... 15/405; 239/291; 239/300; 239/DIG. 22

[58] Field of Search ..... 15/405; 239/291, 292, 239/300, DIG. 7, DIG. 22

[56] References Cited

U.S. PATENT DOCUMENTS

| | | | |
|---|---|---|---|
| B 580,921 | 1/1976 | Frochaux | 239/291 X |
| 2,320,964 | 6/1943 | Yates | 15/405 X |
| 2,917,244 | 12/1959 | Gould | 239/291 |
| 3,117,726 | 1/1964 | Schöberg | 15/405 X |

*Primary Examiner*—Christopher K. Moore
*Attorney, Agent, or Firm*—Wenderoth, Lind & Ponack

[57] ABSTRACT

Apparatus operable by actuating a trigger to cause high-pressure air from a compressor to jet out from the front end opening of a nozzle and to simultaneously produce an air curtain in the form of a conical air layer surrounding the air jet and spreading out from an annular fine clearance provided approximately at the base portion of the nozzle.

5 Claims, 6 Drawing Figures

1
1a
2
3
4
4a
5
5a
5b
5c
6
6a
6b
7
8
9
10
11
12
12a
12b
12c
12'
13
14
15
2c
2c'
2c''

APPARATUS FOR REMOVING DUST HAVING DEVICE FOR PRODUCING AIR CURTAIN

BACKGROUND OF THE INVENTION

The present invention relates to an apparatus for pneumatically removing dust, and more particularly to an apparatus which utilizes high-pressure air from a compressor to produce an air curtain spreading out in a conical form approximately from the base portion of a nozzle and to simultaneously force out a jet of air from the nozzle at the center of the air curtain, with the air jet surrounded by the curtain, so that dust and metal powder resulting from a metal working process or the like can be blown away and removed by the jet of air.

Generally a metal working or fiber processing operation produces a large amount of metal powder or fragments, lint or like dust, which accumulates on part of the workpiece or in a narrow or confined portion of the apparatus such as a groove, causing troubles during the operation. It is therefore desired to provide a pneumatic dust removing apparatus by which the desired part can be cleaned readily and effectively.

However, since conventional apparatuses of this type are so constructed that high-pressure air from a compressor is emitted directly from the nozzle orifice, they entail the hazard that the metal powder or dust, when blown away, will impinge on the user and get into his ege or eyes.

SUMMARY OF THE INVENTION

Accordingly, an object of this invention is to provide a pneumatic dust removing apparatus having a simple construction by which an air curtain in the form of a conical air layer can be spread out approximately from the base portion of a nozzle simultaneously when a jet of air is forced out from the nozzle.

Another object of this invention is to provide a pneumatic dust removing apparatus which is compact, durable, inexpensive and easy to operate with one hand.

Another object of this invention is to provide a pneumatic dust removing apparatus in which one air source is used commonly for the production of an air jet from the nozzle and for the formation of an air curtain spreading approximately from the base portion of the nozzle.

Still another object of this invention is to provide a pneumatic dust removing apparatus in which the angle of spread of the air curtain can be controlled as desired simply by altering the fine clearance between the rear end of a nozzle cap and the front end of the main body of the apparatus.

For a better understanding of this invention, specific embodiments of the invention will be described below.

DESCRIPTION OF THE PREFERRED EMBODIMENTS

Figures 1, 2:
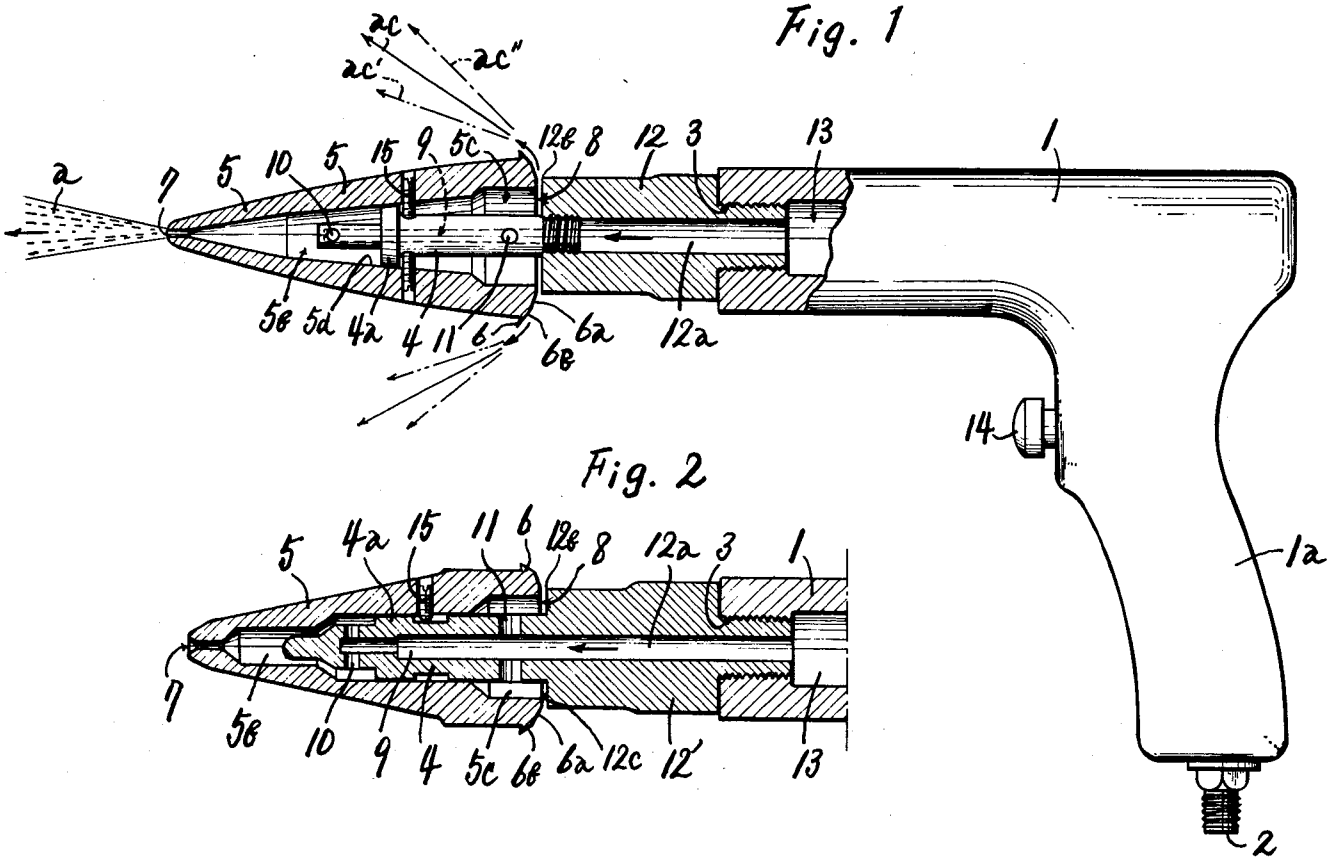
FIG. 1 is a side elevation of a pneumatic dust removing apparatus of this invention, the view being partly in section to show the interior of its front end portion including a nozzle.
FIG. 2 is a side elevation in section showing another embodiment of the same portion.

FIG. 1 shows a pneumatic dust removing apparatus, in the form of a pistol, comprising a handle portion 1*a* and a hollow cylindrical main body 1 integral therewith.

The handle portion 1*a* is provided at its lower end with an inlet 2 for receiving high-pressure air from a compressor. The main body 1 has a front end formed with an outlet 3 for the high-pressure air and which is in communication with the inlet 2 through an air passage 13. The handle portion 1*a* has a trigger 14 and an unillustrated valve operated by the trigger 14, such that the trigger 14, when depressed, opens the valve and permits the high-pressure air admitted through the inlet 2 to flow toward the outlet 3. A hollow cylindrical nozzle support 12 threaded into the outlet 3 at the front end of the main body 1 has a front opening in which a nozzle element 4 is similarly threaded. The nozzle support 12 has a bore 12*a* extending longitudinally therethrough. The nozzle element 4 has an air passageway 9 communicating with the bore 12*a* and has two orifices 10 and 11 diametrically extending therethrough at front and rear portions thereof respectively and in communication with the air passageway 9.

A hollow conical nozzle cap 5 is fitted around the nozzle element 4. The nozzle cap 5 has a forwardly constricted air discharge opening 7 at its front end and a peripheral projection 6 at its rear end. The nozzle cap 5 has an annular rear end surface having an inner portion 6*c* which is perpendicular to the longitudinal axis of said nozzle cap and extending into a first frusto-conical outer surface portion 6*a* and then into a second frusto-conical outer surface portion 6*b*.

A small clearance 8 is formed between the annular rear end surface portion 6*c* of the nozzle cap 5 and the front end surface 12*c* of the nozzle support 12. The clearance 8 is defined as specified by the nozzle cap 5 retained concentrically with the nozzle element 4 by the contact of the inner peripheral surface 5*d* of the cap 5 with the outer periphery of an enlarged portion 4*a* of the nozzle element 4 when the cap 5 is fitted around the element 4, the nozzle cap 5 being secured in position by locking screw(s)15. The hollow interior of the nozzle cap 5 is divided by the enlarged portion 4*a* into a front chamber 5*b* and a rear chamber 5*c*. Because both the rear end inner surface 6*c* of the nozzle cap 5 and the front end surface portion 12*c* of the nozzle support 12 is defined by a plane perpendicular to the axis of the nozzle cap 5 and the nozzle support 12, the small clearance 8 defined by the surface portion 6*c* and surface 12*c* and positioned radially inwardly of the first frusto-conical surface portion 6*a* is parallel with these surfaces and is annular. The size of the small clearance, i.e. the distance between the opposed surfaces, is controllable by shifting the locking screws 15 relative to the nozzle element 4 which screws fasten the cap 5 to the element 4. Preferably the actual value of the clearance 8 is more than zero but no greater than 0.1 mm.

Figure 3:
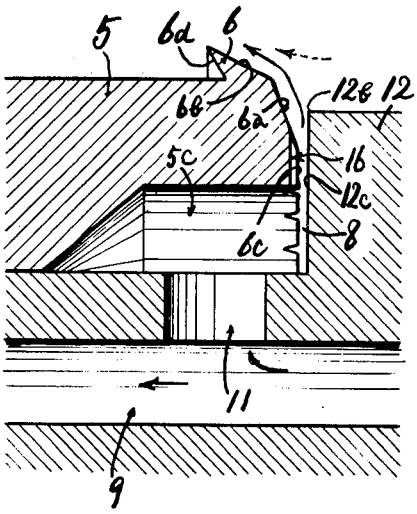
FIG. 3 is an enlarged view in section showing part of the rear portion of a nozzle cap.
Figure 4:
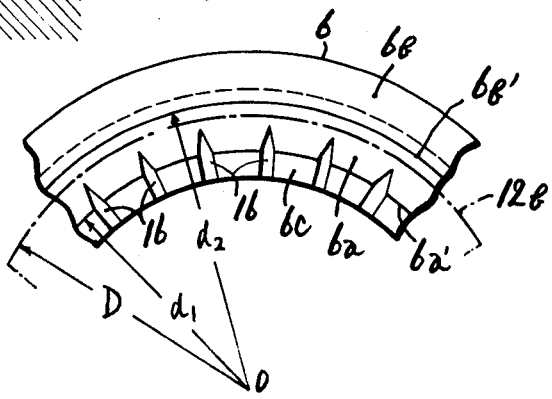
FIG. 4 is a fragmentary enlarged view showing the end surface of the nozzle cap of FIG. 3.

With reference to FIGS. 3 and 4, a corner portion 6*a'* which is the boundary between the perpendicular rear surface portion 6*c* of the nozzle cap 5 and the first frusto-conical surface portion 6*a* of the same is at a radius $d_1$ about the central axis 0 which radius is smaller than the D of the outer periphery 12*b* of the front end surface 12c of the nozzle support 12. Furthermore, the radius $d_2$ of a corner portion 6b' which is the boundary between the first frusto-conical surface portion 6a and the second frusto-conical surface portion 6b is greater than the radius D of the outer periphery 12b. Accordingly, the corner portion 6a' adjoining the first frusto-conical surface portion 6a is positioned inwardly of the outer periphery 12b of the opposed vertical surface 12c.

Figure 6:
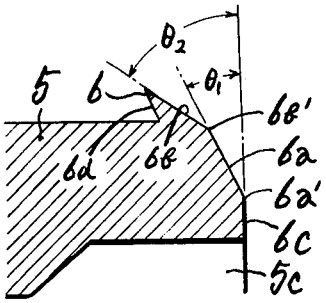
FIG. 6 is an enlarged view in section showing part of the rear end portion of the nozzle cap of FIG. 5.

With reference to FIG. 6, the angle $\theta_1$ between the first frusto-conical surface portion 6a and a plane perpendicular to the axis O, i.e. the plane of the perpendicular surface portion 6c is smaller than the like angle $\theta_2$ of the second frusto-conical surface portion 6b. For example, the angle $\theta_1$ is 20° to 30°, and the angle $\theta_2$ is 45° to 60°. More preferably $\theta_1$ is 26° and $\theta_2$ is 48°. Between the peripheral projection 6 and the outer peripheral surface of the nozzle cap 5, there is formed an annular cutout 6d having an acute angle.

FIG. 2 shows another embodiment having substantially the same construction as the embodiment of FIG. 1 except that the nozzle element 4 and a member 12' corresponding to the nozzle support 12 are in the form of an integral piece. Throughout FIGS. 1 and 2, like parts are referred to by like reference numerals and characters.

Figure 5:
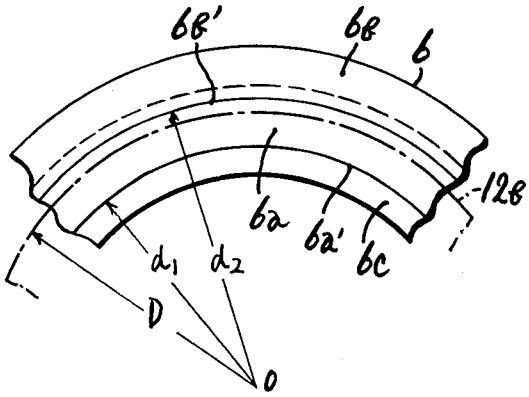
FIG. 5 is a view similar to FIG. 3 and showing another embodiment.

As shown in FIGS. 3 and 4, the perpendicular rear end surface portion 6c of the nozzle cap 5 has with a number of radial cutout grooves 16 circumferentially spaced at equal intervals. The cutout grooves 16 may be shallow grooves, for example, V-shaped in section and extending from the inner periphery of the nozzle cap to an intermediate portion of the first frusto-conical surface portion 6a. The cutout grooves 16 may be omitted as shown in FIGS. 5 and 6.

The apparatus described above operates in the following manner. The handle portion 1a is grasped by one hand, and the trigger 14 is depressed, with an unillustrated air conduit of a compressor (not shown) connected to the inlet 2 at the lower end of the handle portion 1a. When depressed, the trigger 14 opens the unillustrated valve incorporated in the handle portion 1a, permitting the high-pressure air from the compressor to flow through the air passage 13 toward the outlet 3 at the front end of the main body 1 and pass through the bore 12a into the air passageway 9 within the element 4, from which the air jets out through the front and rear orifices 10 and 11 separately. The air emitted from the front orifice 10 into the front chamber 5b of the nozzle cap 5 is pressurized therein and forced out forwardly from the air discharge opening at the front end of the nozzle cap 5. The jet of air a thus discharged blows away metal powder, lint or like dust.

On the other hand, the air flowing out of the rear orifice 11 of the nozzle element 4 into the rear chamber 5c of the nozzle cap 5 is forced radially outwardly through the small clearance 8. Because the clearance 8 is very small, the high-pressure air is greatly pressurized within the rear chamber 5c and, by being confined by the clearance 8, the air is further pressurized when flowing outward. Accordingly, the extremely high pressure created in the vicinity of the outer peripheral rear portion of the rear chamber 5c gives rise to an ejecting action.

Although the compressed air thus discharged tends to flow radially outwardly while being guided by the surface 12c, the air is deflected, before reaching the outer periphery 12b, in a forwardly inclined direction along the first frusto-conical surface portion 6a by which the clearance is abruptly enlarged. The air is further guided outwardly by the second frusto-conical surface portion 6b as indicated by a solid arrow in FIG. 3, whereby the air is further guided in a further forwardly inclined direction while entraining some of the adjacent ambient atmosphere as secondary air and thereby being strengthened. Consequently an air curtain ac is produced which is in the form of a conically spreading annular air layer.

In order to effect the ejecting action precisely in circular fashion, the small clearance 8 must be uniform throughout the entire circumference thereof. If the nozzle cap 5 should be eccentric to the nozzle element 4, or should the perpendicular rear end surface portion 6c of the nozzle cap 5 fail to be parallel to the front end surface 12c of the nozzle support 12 even to the slightest extent, the air would then flow out irregularly without forming an annular air layer, possibly producing a split annular air layer. To eliminate such objection resulting from the unevenness of the fine clearance 8, the rear end surface portion 6c of the nozzle cap 5 has the radial cutout grooves 16 therein which are spaced circumferentially at equal intervals as seen in FIGS. 3 and 4. Accordingly, even when the parallel arrangement of the surfaces defining the clearance 8 involves slight irregularities, the high-pressure air passing through the clearance 8 flows through the cutout grooves 16 in the form of individual streams and through the other portion in the form of a film, with the result that the air forms the same fowardly spreading flow as described above by subsequently being guided along the first frusto-conical surface portion 6a and the second frusto-conical surface portion 6b. As the air spreads out forward, the adjacent streams join each other and form a complete conical air layer.

As already described, the distance defining the small clearance 8 can be varied by shifting the locking screw(s) 15. When decreased, the clearance 8 reduces the amount of air flow therethrough, increasing the angle of inclination of the air curtain and deflecting the air flow as indicated by the dot-and-dash line ac'' in FIG. 1. Conversely when increased, the clearance 8 increases the amount of air flow and produces an air curtain ac' at a reduced angle of inclination. In this way, the angle of inclination of the air curtain ac can be readily altered by controlling the small clearance 8. Practically, the angle defining the vertex of the cone of the air curtain ac can be varied in the range of from 30° to 120° by controlling the small clearance 8 when the pressure of air supplied is 5 Kg/cm$^2$.

Since the peripheral projection 6 has the acute angle cutout 6d, the air flow guided by the second frusto-conical surface portion 6b leaves the edge of the frusto-conical surface portion 6b in a clear-cut fashion, without creating a swirling current or turbulence at the edge portion which would interfere with the flow velocity.

As will be apparent from the foregoing description, the apparatus of this invention is operable simply by depressing the trigger, such that the high-pressure air supplied from a compressor can be forced out from a discharge opening at the front end off the apparatus while surrounded by a conical curtain which is simultaneously formed by spreading out air from the same source from a small clearance at the rear end of a nozzle cap. When metal powder or like dust is blown away, the air curtain prevents particles of the dust from impinging against the user to ensure a safe operation. Furthermore, the present apparatus is durable, simple in construction and inexpensive to manufacture.

This invention is not limited to the emobiments described above but may be modified variously within the scope of the technical concept of this invention as defined by the appended claims.

What is claimed is:

1. An apparatus for pneumatically removing dust, comprising:

a hollow cylindrical main body and integral handle portion having an inlet for receiving high pressure air from a source of high pressure air, the main body having an outlet for the high pressure air at the front end thereof;

a hollow nozzle element secured to the outlet of the main body for receiving high pressure air therefrom and having a hollow conical nozzle cap fitted around the nozzle element and secured thereto, the nozzle cap having an air discharge opening in its front end in communication with said front orifice in said nozzle element and having an annular surface at the rear end thereof having an inner portion which is perpendicualr to the longitudinal axis of said nozzle cap, and at least two contiguous frusto-conical outer portions angling at successively greater angles toward the front of said nozzle cap, the front end of said main body having a surface thereupon parallel to said perpendicular portion of said annular surface to define a small clearance therebetween and extending radially outwardly of said longitudinal axis a distance which is between the inner and outer radial dimensions of the innermost frusto-conical portions of said annular surface, the inner end of said clearance being in communication with said rear orifice, whereby high pressure air is forced out of said air discharge opening in said nozzle cap to form a jet of high pressure air and when the high pressure air is simultaneously forced out through said clearance it forms a conical air curtain spreading forwardly from the forward edge of the outermost frusto-conical portion.

2. An apparatus as claimed in claim 1 in which said perpendicualr portion of said annular surface has a plurality of radially extending grooves therein spaced at equal intervals peripherally therearound and having the radially outer ends thereof opening into the inner frusto-conical surface portion for delivering substantially uniform amounts of high pressure air to equally spaced points around the annular surface, whereby the amount of air from said grooves spread over said frusto-conical surface portions to form said conical air curtain.

3. An apparatus as claimed in claim 1 in which said nozzle cap is mounted on said nozzle element for movement toward and away therefrom along the axis thereof for adjusting the size of said small clearance.

4. An apparatus as claimed in claim 1 in which the air flow path within said nozzle element and said nozzle cap from said outlet of said main body to said air discharge opening is longer than the air flow path within said nozzle element and said nozzle cap from said outlet of said main body to said small clearance, whereby when the flow of high pressure air is first started the air curtain is formed before the jet of high pressure air.

5. An apparatus as claimed in claim 1 in which said nozzle cap has a peripheral projection thereon the outer surface of which is the outermost of said frusto-conical outer portions, the inner surface of said peripheral projection being at an acute angle to the outer peripheral surface of said nozzle cap to define an annular cutout therewith, the inner and outer surfaces of said peripheral projection meeting at the outer tip of said projection in an acute angle, whereby the air flow along the outer surface of said peripheral projection leaves said surface in a clean cut flow.

* * * * *